US007077367B2

(12) United States Patent
Dowd

(10) Patent No.: US 7,077,367 B2
(45) **Date of Patent: *Jul. 18, 2006**

(54) DISPLAY STAND

(75) Inventor: Michael Dowd, London (GB)

(73) Assignee: Dimensions Displays Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/377,837

(22) Filed: Mar. 3, 2003

(65) Prior Publication Data

US 2004/0004166 A1 Jan. 8, 2004

Related U.S. Application Data

(63) Continuation-in-part of application No. 10/118,307, filed on Apr. 8, 2002, now Pat. No. 6,604,718.

(30) Foreign Application Priority Data

Mar. 5, 2002 (GB) ..... 0205152

(51) Int. Cl.
*F16M 13/00* (2006.01)

(52) U.S. Cl. ..... 248/158; 248/159; 248/127

(58) Field of Classification Search ..... 248/158, 248/159, 127, 176.1, 460, 160, 165; 40/610; 50/149

See application file for complete search history.

(56) References Cited

U.S. PATENT DOCUMENTS

| | | | | |
|---|---|---|---|---|
| 2,419,181 | A * | 4/1947 | Watson | 40/603 |
| 4,148,520 | A * | 4/1979 | Miller | 297/16.2 |
| 4,421,356 | A * | 12/1983 | Singer | 297/16.1 |
| 4,728,066 | A * | 3/1988 | Lang et al. | 248/165 |
| 5,983,545 | A * | 11/1999 | Marco | 40/610 |
| 6,332,284 | B1 * | 12/2001 | Tafforeau | 40/603 |
| 6,604,718 | B1 * | 8/2003 | Dowd | 248/158 |

* cited by examiner

*Primary Examiner*—A. Joseph Wujciak, III
(74) *Attorney, Agent, or Firm*—Fay, Sharpe, Fagan, Minnich & McKee, LLP

(57) ABSTRACT

A self-supporting display stand comprising a rigid base, a pair of upstanding rod-like support masts mounted on the base, and a corresponding pair of tension cables which connect the upper ends of the masts to the base. The upper end of each cable is connected to the upper end of the corresponding mast by means of a first connector which co-operates with the upper end of the mast. The lower end of the cable is connected to the base by means of a second connector having a body which is adapted to be retained in a suitably shaped socket or aperture in the base.

7 Claims, 12 Drawing Sheets

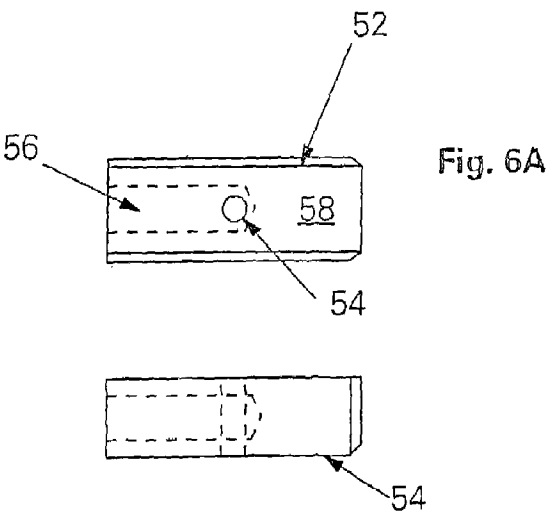
Fig. 6A
Fig. 6B
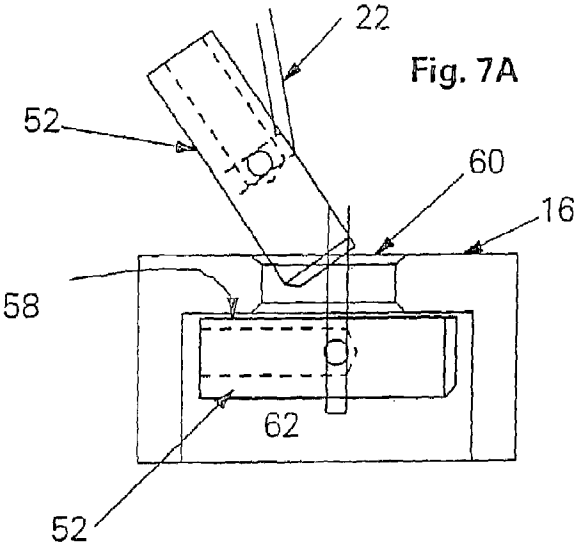
Fig. 7A
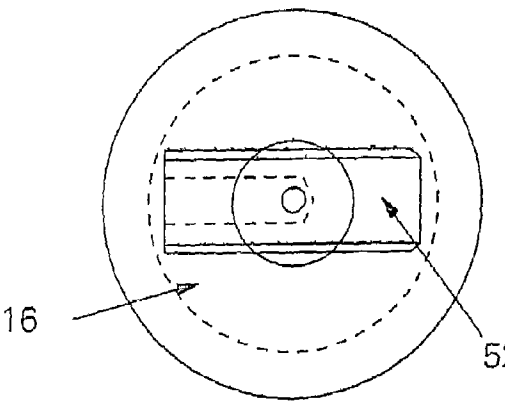
Fig. 7B

DISPLAY STAND

This application is a continuation-in-part of U.S. Ser. No. 10/118,307 which was filed on Apr. 8, 2002, now U.S. Pat. No. 6,604,718.

This invention relates to display stands, and particularly to free-standing, self-supporting display stands which are designed to be easily dismounted and reassembled, for example, for use at exhibitions.

It is known to construct self-supporting display stands in the form of a relatively heavy rigid base, on which are mounted a pair of upstanding support masts, whose upper ends are connected back to the base by means of tension cables. Such a display stand will be referred to below as "a stand of the type herein described". Usually the base is made of metal and the masts are of a stiff material such as carbon fibre. A stand of this kind can be used to support various types of fabric screens, leaflet or brochure displays and the like, and has the advantage of being free-standing.

A well-known problem in the construction of devices of this kind, is that it is difficult to secure the components together reliably, whilst allowing for quick assembly and disassembly. When the cables are attached to the upper ends of the support masts, and to the base, for example, considerable care is required to ensure that they are properly secured because the whole structure is in a tensioned condition when it is assembled. Similarly, the process of disassembly must be carried out with care, to avoid accidents caused by unexpected release of the secured components.

Accordingly the present invention provides a self-supporting display stand comprising a rigid base, a pair of upstanding rod-like support masts mounted on the base and a corresponding pair of tension cables which connect the upper ends of the masts to the base, characterised in that each cable is connected to the upper end of the corresponding mast by means of a retaining member fixed to the upper end of the cable which co-operates with the end of the mast so that it is held in engagement when the cable is under tension, and the cable is connected to the base by means of an enlarged connector member, fixed to the lower end of the cable, which can be trapped in the base behind a suitably-shaped retaining aperture.

In a preferred embodiment of the invention, the cable is provided with a relatively small fixed connector attached to its upper end which can be threaded through a retaining aperture in the base, from below, so as to leave the lower end, which has a larger connector member, trapped behind the aperture. The upper end of the mast is open-ended and has a short slot extending from the open end, along one side, so that the upper end of the cable can be attached by dropping the small fixed connector into the end with the cable passing through the slot. This arrangement avoids the requirement for clamping screws and greatly simplifies the assembly process.

Preferably, in this case, both connectors are ball-shaped or cylindrical, and are secured to the cable by soldering or a similar process, in a permanent manner, since the process of assembling the stand does not require them to be detachable.

The cable may also include a further intermediate connector member which is also preferably ball-shaped, fixed relatively nearer to the upper end to facilitate the attachment of a cross member which forms a transverse rail. In a preferred arrangement the transverse rail is tubular, and has a shaped part-circumferentially-extending slot near each end which enables it to be hung onto the corresponding ball-shaped member. At least one further transverse rail is also provided, comprising a tubular member with shaped axial slots at each end which enable it to be clipped directly onto the cable.

Another embodiment of the present invention provides a self-supporting display stand comprising a rigid base, a pair of upstanding rod-like support masts mounted on the base, and a corresponding pair of tension cables which connect the upper ends of the masts to the base, characterised in that the upper end of each cable is connected to the upper end of the corresponding mast by means of a first connector comprising a ferrule having a recess which fits over the mast, and a clamping device for securing the upper end of the cable; the lower end of the cable being connected to the base by means of a second connector having a body which is adapted to engage in a suitably shaped socket or recess in the base, and also includes a clamping device for securing the lower end of the cable.

In accordance with a further aspect of the present invention, there is provided a base for a display stand, comprising a first pair of relatively closely spaced apart sockets for receiving the lower ends of corresponding support masts, and a second pair of sockets or apertures, which are more widely spaced apart, for connecting the lower ends of respective tension cables whose upper ends are each attached to one of the masts; each of the second pair of sockets or apertures being adapted to receive and retain a connector member attached to the lower end of the cable.

According to a further aspect of the invention, there is provided a connector which is adapted to secure the upper end of a tension cable of a display stand, to the upper end of a support mast which is to be held under tension by the tension cable, the connector comprising a ferrule including a blind axial bore extending from one end and adapted to fit over the upper end of the mast, and a transversely extending slot or passageway adapted to receive the end of the cable, which is provided with clamping means, adapted to be tightened onto the cable to secure it in position. Preferably, the slot or passageway is located between the inner end of the bore and the other end of the ferrule and the clamping means comprises a grub screw which is located in a threaded passage of the inner end of the bore, so that the screw is concealed, after assembly.

A yet further aspect of the invention provides a connector adapted to secure the lower end of a tension cable to the base of a display stand, and comprising an elongate body provided with a transversely extending slot or passageway to receive the lower end of the tension cable, and an axially extending bore communicating with the passageway, in which there is mounted a clamping device adapted to be tightened to hold the end of the cable in position, whereby the connector body forms a toggle which can be inserted axially into a re-entrant recess in the base, and which then automatically assumes a locked position.

A still further aspect of the present invention provides a connector for mounting a shelf or other laterally extending support member on a tension cable of a display stand, comprising an elongate body having a first laterally extending recess adapted to receive the laterally extending member, a second recess or passageway which also extends laterally, but at right angles to the first recess, and is adapted to receive the cable, and an axial bore extending inwardly from each end of the body, which is threaded to receive a clamping screw, so that the transversely extending member and the tension cable can both be clamped into their respective recesses.

Some embodiments of the invention will now be described, by way of example with reference to the accompanying drawings in which:

FIG. 1*a* is a front perspective view of a display stand in accordance with the invention, FIG. 1*b* is a side elevation of the display stand of FIG. 1*a;*

FIG. 1*c* is a perspective view, taken from an angle and one side;

Figures 5A, 5B:
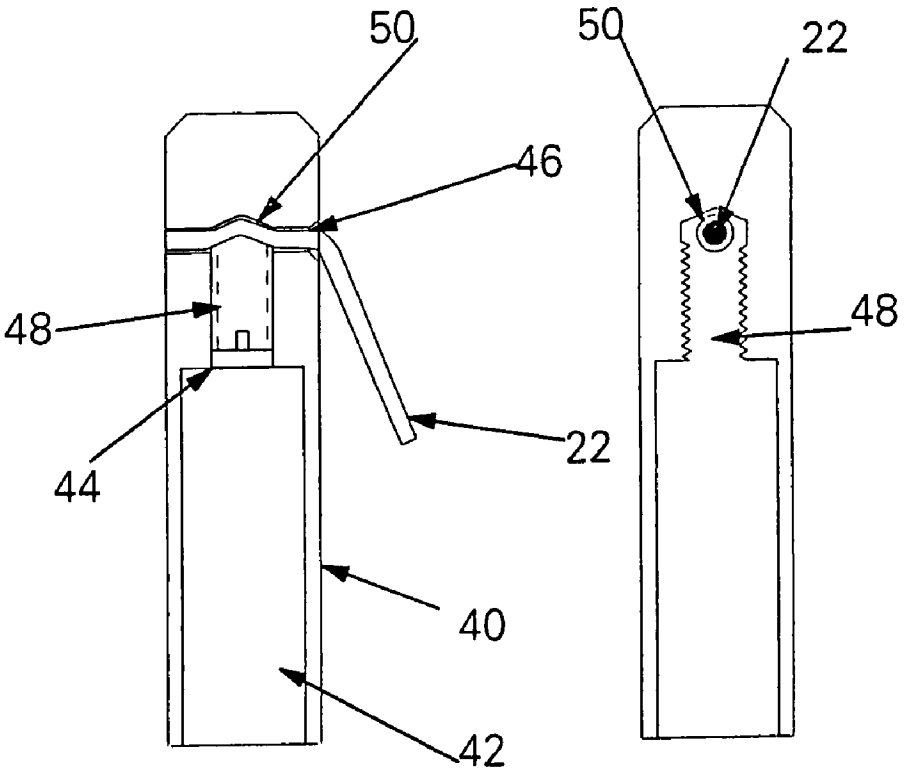

FIG. 5*a* is an axial cross-section through a first type of connector according to the invention;

FIG. 5*b* is an axial cross-section through the connector of FIG. 5*a*, and taken at right angles to the cross-section of FIG. 5*a;*

FIG. 6*a* is a plan view of a second type of connector according to the invention;

FIG. 6*b* is a side elevation of the connector of FIG. 6*a;*

Figure 8B:
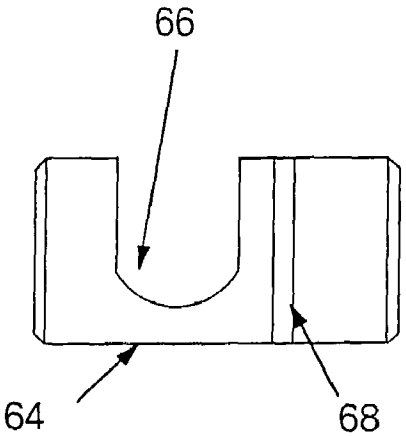
Figure 8A:
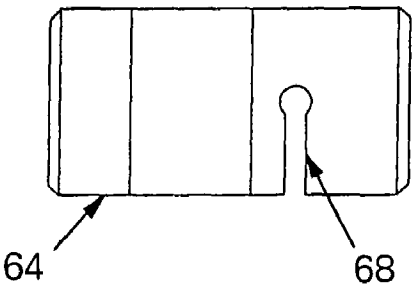

FIG. 7*a* is a schematic diagram illustrating the steps of attaching a connector to a base component;

FIG. 7*b* is a plan view showing the connector arrangement of FIG. 7*a*, after assembly;

FIG. 8*a* is a plan view of a third type of connector in accordance with the invention;

FIG. 8*b* is a side elevation of the connector of FIG. 8*a;*

Figure 8C:
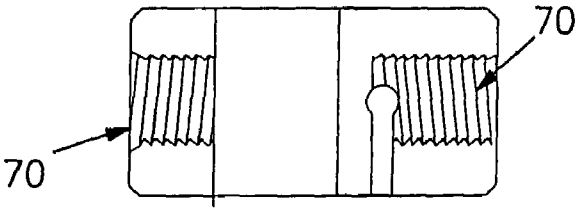

FIG. 8*c* is a horizontal cross-section through the connector of FIG. 8*a;*

Figure 9B:
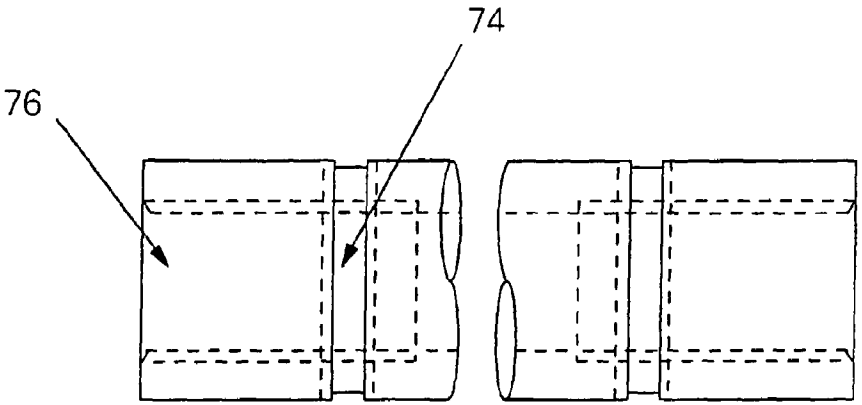
Figure 9A:
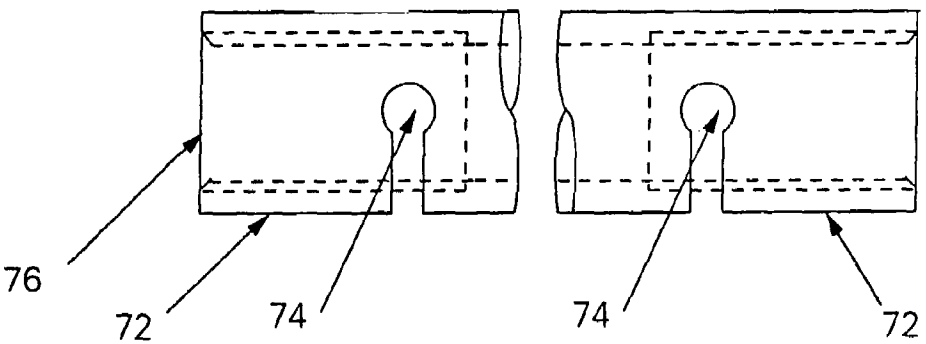

FIG. 9*a* is a plan view showing the ends of a transverse support rod;

FIG. 9*b* is a side view of the rod of FIG. 9*a;*

Figure 9C:
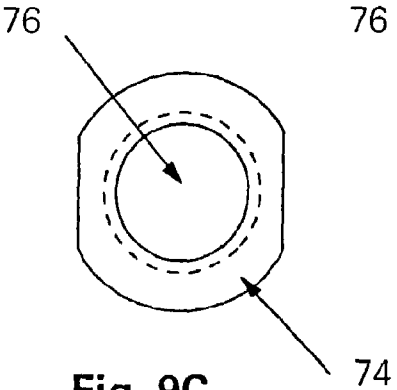

FIG. 9*c* is a cross-section on the line A—A of FIG. 9*a;*

Figure 10:
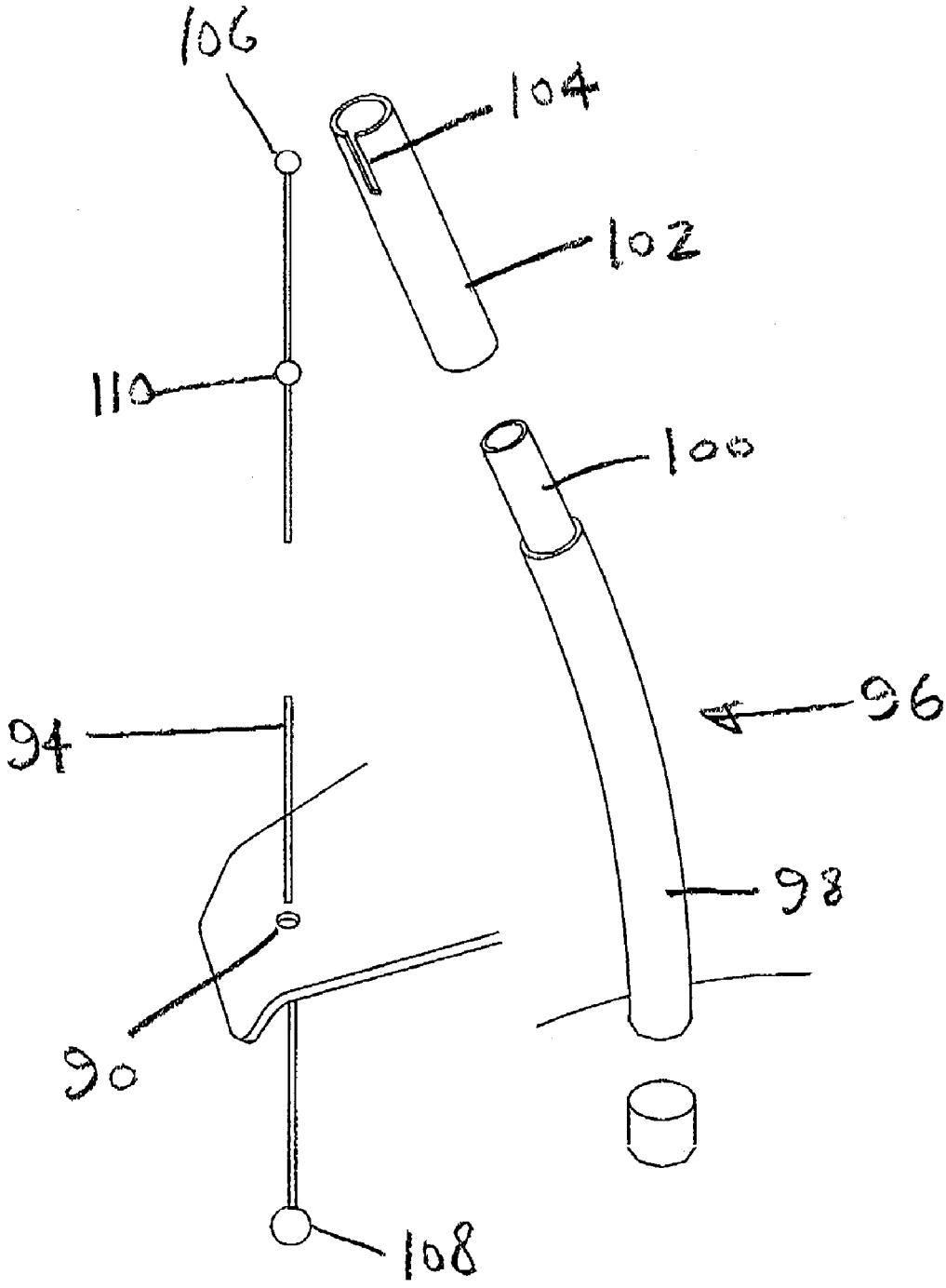
Figure 11:
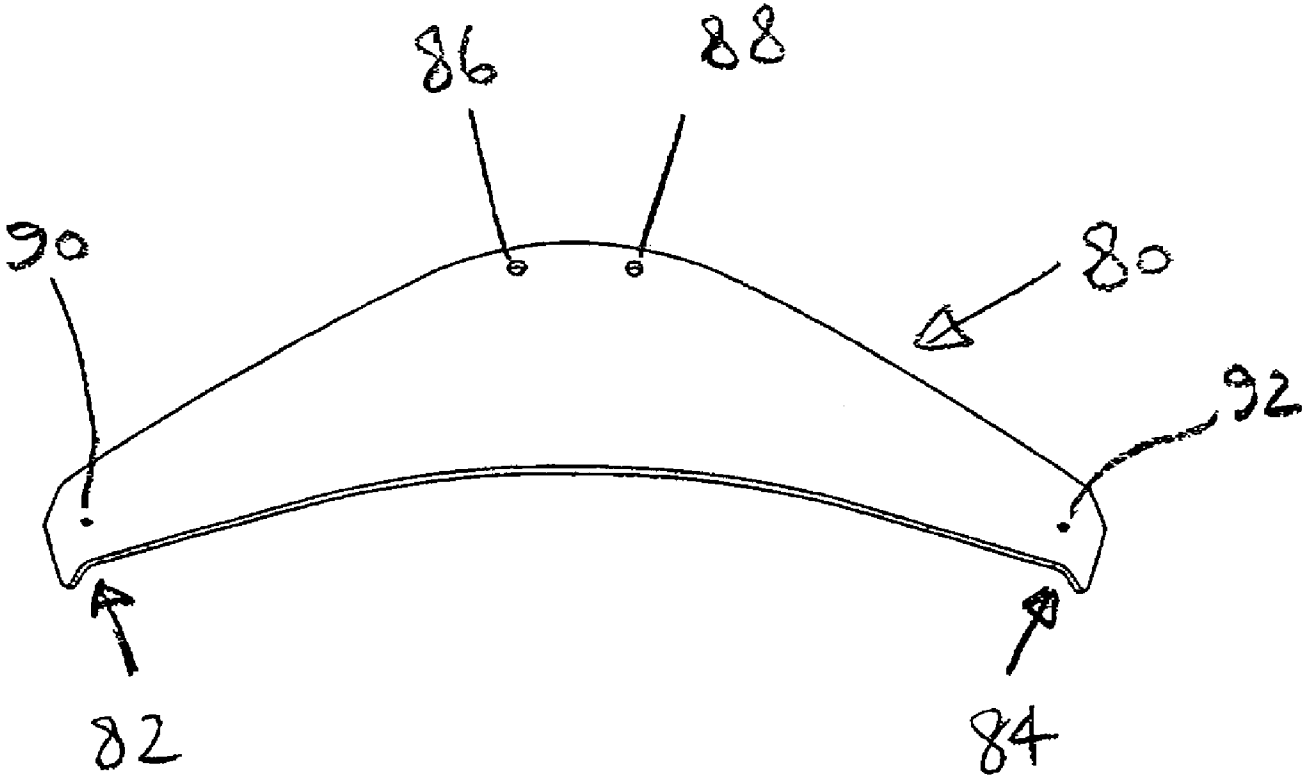

FIG. 10 is a partial view of a preferred embodiment of the invention;

FIG. 11 is a perspective view of a base used in the embodiment of FIG. 10;

FIG. 12 shows one type of transverse rail mounting; and

FIG. 13 shows an alternative rail mounting.

Figures 1, 1A, 1B, 1C:
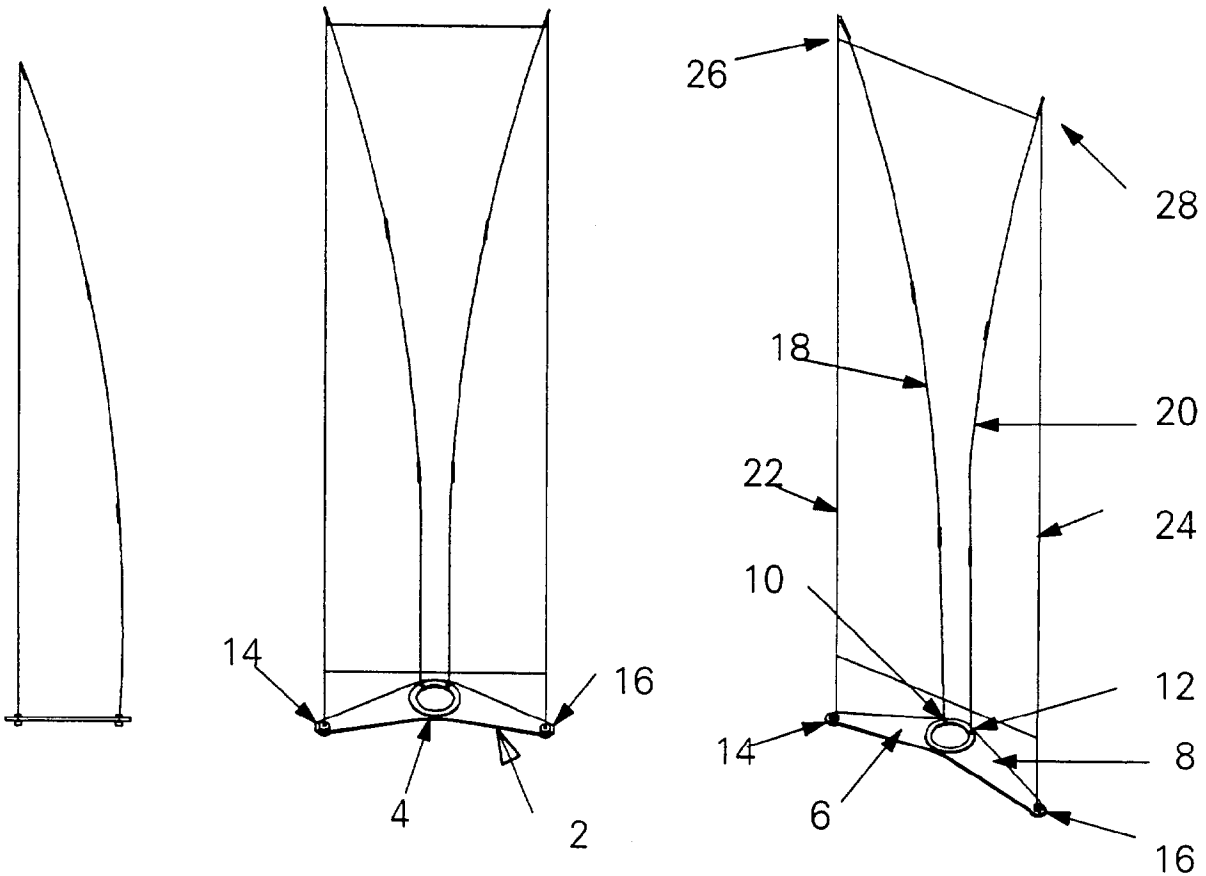

Referring to FIG. 1, the display stand comprises a base 2, which as shown includes a central circular section 4, including a pair of outwardly extending "wings" 6 and 8, which are positioned at approximately 150° to one another, so as to impart added stability to the base.

The central section 4 is formed with a pair of spaced apart sockets 10 and 12, positioned towards the rear of the base, to receive upstanding mast members 18 and 20, whilst the outer ends 14 and 16 of the wings 6 and 8 are provided with sockets for attaching the lower ends of the tension cables 22 and 24. The upper ends of the tension cables are connected to the upper ends of corresponding masts 18 and 20, by connectors indicated generally at 26 and 28.

The masts 18 and 20 are made of relatively stiff but resilient material such as carbon fibre, and the tension cables 22 and 24 are of a suitable length so as to maintain the masts 18 and 20 in a slightly bowed condition, as illustrated in the drawings, when the display stand is assembled.

Figure 2:
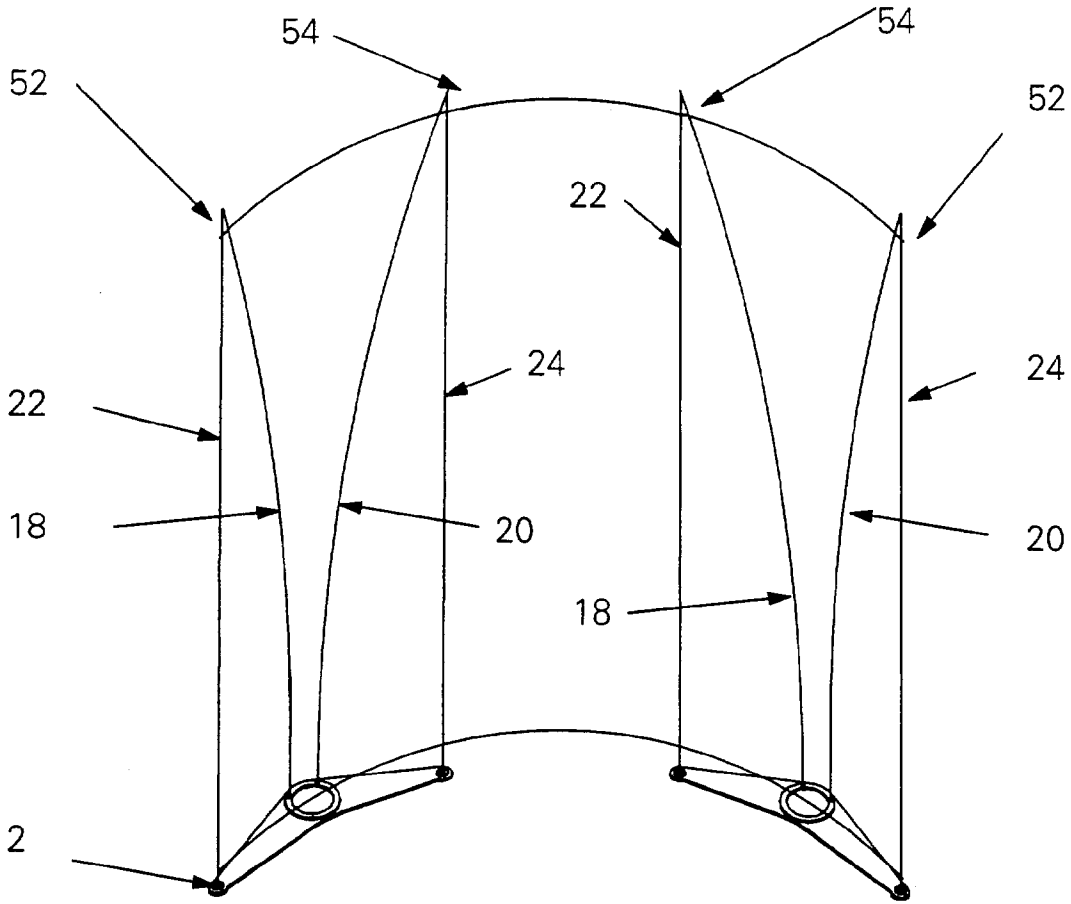
FIG. 2 is a front perspective view of a display assembly comprising two stands of the kind shown in FIG. 1.

This makes it possible to provide a rigid and stable construction, with a minimum number of simple components, which is capable of supporting a variety of display stand arrangements. For example, as shown in FIG. 1, the stand can support a fabric screen attached to the display cables on either side, or a pair of stands can be arranged as shown in FIG. 2 to support a wider screen, the fabric being suitably connected to the tension cables 22 and 24 at its edges, and also, if appropriate, in the central regions in the arrangement of FIG. 2.

Figure 3:
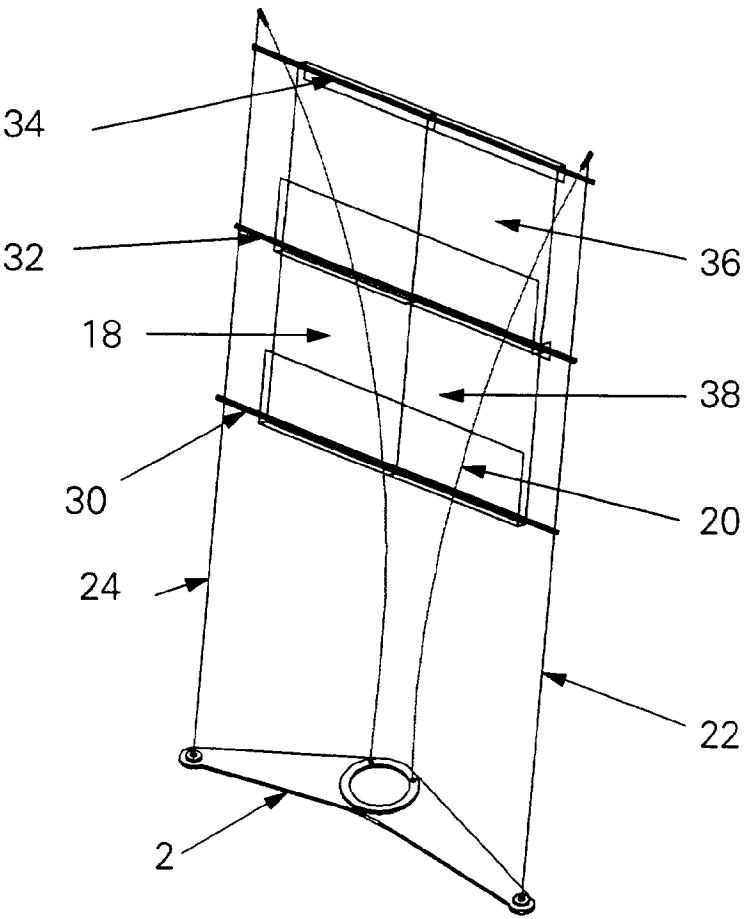
FIG. 3 is a perspective view, taken from one side, and showing an alternative configuration of the display stand of FIG. 1.
Figure 4:
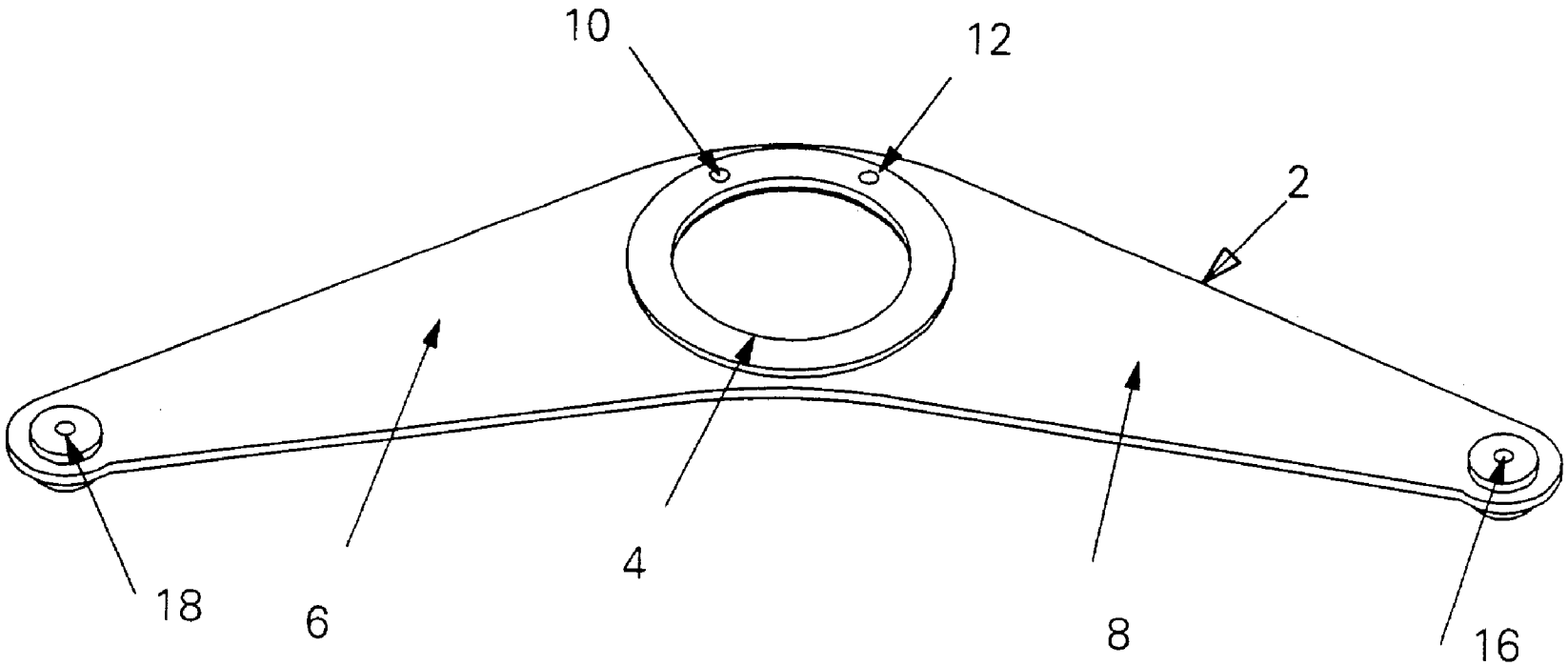
FIG. 4 is a perspective view of a base for a display stand.

Similarly, FIG. 3 shows an arrangement in which transverse rods 30, 32 and 34 are attached to the masts 18 and 20, and support leaflet holders 36 and 38.

In order to make the structure as easy as possible to assemble, whilst ensuring that the components are reliably connected, a ferrule type connector of the kind shown in FIG. 5 may be used to attach the top of each cable 22, 24 to the top end of the mast. As shown in FIG. 5*a* the ferrule comprises a metal body 40 having a main axial bore 42 which is of a suitable size to fit snugly over the upper end of one of the support masts, so that the blind end 44 sits on the upper end of the mast.

The other end of the ferrule is formed with a transverse passageway 46, and a further, relatively narrow axial bore 48 extends between the main bore 42, and the radial bore 46, and is threaded to receive a dog point grub screw. Accordingly, when the end of a tension cable 22 is inserted in the bore 46, it can be secured tightly in position by tightening the grub screw, using a screwdriver inserted in the main bore 42 of the ferrule. As will be clear from the drawing, the inner end 50 of the bore 48 is formed as a shallow cone shape, so that the tension cable 22 is slightly distorted by the grub screw, as its point advances towards the cone.

In order to secure the lower end of the tension cable to the base, a connector of the kind shown in FIG. 6 is used, which again comprises an elongate body 52 having a transversely extending passageway 54 to receive the end of the tension cable, and an axial bore 56, corresponding to the bore 48 of connector 40, in which a grub screw can be tightened to secure the end of the cable. Once again, the inner end of the bore 56 is formed as a shallow cone, in order to tightly grip the end of the tension cable.

As will be clear from the end view of FIG. 6*c*, the connector 52 has a flattened upper surface 58, which serves to locate the connector in the correct orientation, when it is inserted in the corresponding socket of the base. The process of installing the connector 52 is illustrated in FIG. 7*a*, in which it will be seen that the connector is inserted into a relatively narrow aperture 60 in the top of the hollow socket 16 of the base, and since the internal diameter of the chamber 62 formed inside the socket 16 is greater than that of the aperture 60, the connector then takes up a horizontal position, in which it is trapped in the internal chamber. Because of the tension in the cable, the flattened upper surface 58 of the connector then sits tightly against the inside surface of the top of the chamber 62, with the tension cable 22 passing through the aperture 60.

It will be appreciated that, as an alternative to the "toggle" type of connection, it would also be possible to form the connector body and socket with co-operating bayonet type formations.

FIG. 8 illustrates a further type of connector, which may be utilised in conjunction with transverse support rods 30, 32 or 34 of the kind illustrated in FIG. 3, in order to connect them to the tension cables 22 and 24. As shown in the drawing, each connector comprises an elongate body 64, formed with a large transverse slot 66 (best seen in FIG. 8*b*) in which the transverse support bar is secured. A narrower, vertically extending slot 68 is formed adjacent the recess 66, so that it can be slid over the tension cable, and the opposite ends of the connector 64 are each formed with a threaded bore 70, for a retaining bolt, which is tightened up against the transverse rod 30, or the tension cable 22/24, respectively.

In use, a connector 40 is attached to the upper end of the tension cable, as described above with reference to FIG. 5, while a connector 52 is attached to the lower end. With the masts 18, 20 inserted in their respective sockets 10, 12 in the base, the connector 40 on the upper end of the tension cable is dropped over the upper end of the corresponding mast, and the connector 52 is inserted into the corresponding base socket 16 (as described above with reference to FIG. 7).

Once both the tension cables 22 and 24 have been attached, the assembly is quite rigid, and further transverse support rods such as 30, 32 and 34 illustrated in FIG. 3 can then be attached, by means of connectors 64 of the kind shown in FIG. 8. Since these connectors are designed to be attached after assembly of the main structure, the slots 68 enable them to be slid onto the tension cables at any desired position, and then secured by tightening the appropriate bolt in the end of the connector. The transverse rod can then be secured in the recess 66, and any required leaflet holders or dependent hooks or the like can easily be attached.

Alternatively as shown in FIG. 9, each end 72 of the transverse support rod may be formed with a transverse slot 74 to receive a tension cable, and a threaded axial bore 76 for a clamping screw so that each end of the support rod can be connected directly onto a support tension cable. This reduces the number of components required to assemble the complete structure. If necessary, additional connectors 64 as shown in FIG. 8 can also be utilised at intermediate points along the length of the support rod.

A particularly advantageous version of the invention is illustrated in FIGS. 10 to 13 in which FIG. 10 illustrates the overall differences between this and the previous described versions. As shown in FIGS. 10 and 11, the base 80 again includes a pair of outwardly extending "wings" 82 and 84, which are positioned at approximately 150 degrees to one another, so as to impart added stability to the base. The outer edges of these two wings are turned downwards. Turning the wings down at their outer edges has the effect of raising the base to create a lower space for concealing the lower tension cable connector, as explained in more detail below.

The central section of the base is formed with a pair of spaced apart sockets, 86 and 88, positioned towards the rear, to receive the upstanding masts as before whilst the outer ends of the wings are provided with apertures 90 and 92 for attaching the lower ends of the tension cables 94 (FIG. 10).

As illustrated in FIG. 10 each mast 96 comprises two sections. The lower section 98 comprises an outer tube, enclosing a longer inner tube 100 which protrudes from the upper end and provides a spigot for an upper section 102, so that the lower section is relatively stiff. The upper end of the tube 102 is formed with an axial slot so as to receive and retain a small ball-shaped connector 106 on the upper end of the cable 94.

The aperture 90 of the base is larger than the upper ball connector 106, but smaller than the lower ball connector 108, so that the cable can be threaded through the base from below leaving the ball 108 trapped beneath the base. With the mast assembled and mounted in its socket, it can then be flexed slightly to allow the upper end of the cable carrying the ball 106 to be dropped into the upper end of the mast section 102 so that the whole assembly will be held together by the tension in the cable which is, of course, made of a suitable length relative to the mast.

Figures 12A, 12B, 12C:
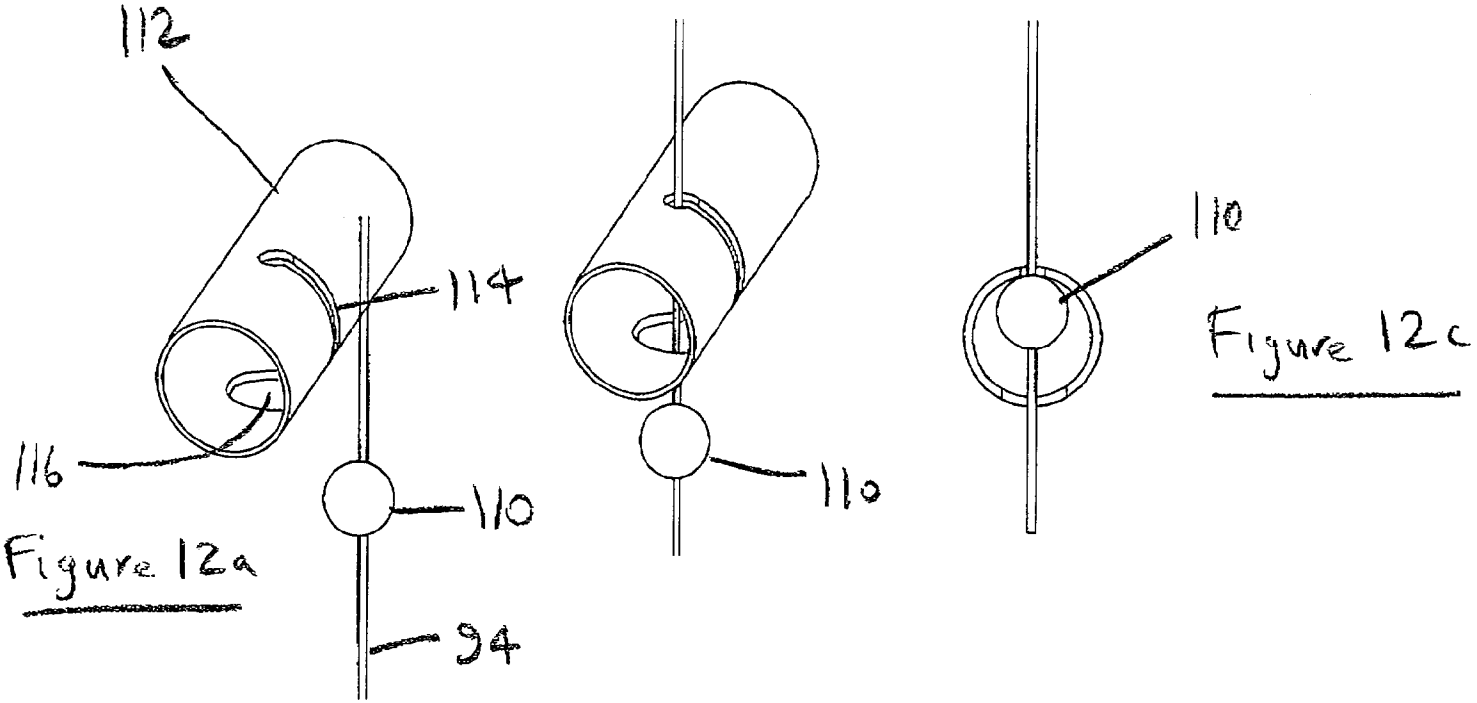

The cable is also provided with another ball-shaped connector member 110, of similar size to connector 106, towards its upper end so that a transverse rail 112 can be mounted on it as shown in FIGS. 12*a* to 12*c*. This illustrates how each end of the rail, which is tubular, is formed with a shaped slot 114 extending partly around its circumference, which has an enlarged opening 116 at its lower end so that it can be brought into engagement with the corresponding cable 94 and slid down over the connector 110 which is then trapped inside the tube (FIG. 12*c*).

Figures 13A, 13B:
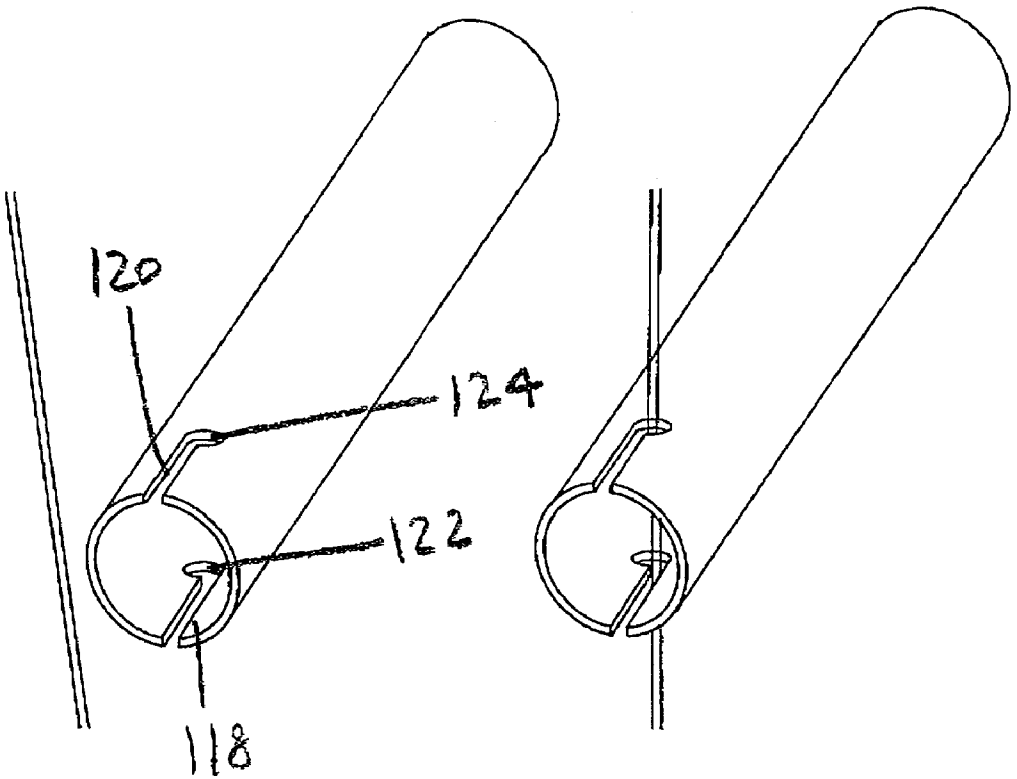

Further transverse rails may be attached to the cable 94 by an arrangement of the kind shown in FIGS. 13*a* and 13*b*, which allows them to be connected to any part of the cable 94. This comprises a pair of diametrically-opposed axial slots 118, 120, having short inner end portions extending circumferentially in the same sense so as to form a "bayonet" connection which can be slid over the cable and twisted into engagement with it. For this purpose, the slots are preferably made of such a width as to be an interference fit around the cable.

The invention claimed is:

1. A self-supporting display stand comprising a rigid base, a pair of upstanding support masts mounted on the base, and a corresponding pair of tension cables which connect the upper ends of the masts to the base, each cable being connected to the upper end of the corresponding mast by means of a first connector member fixed to the upper end of the cable, which co-operates with the end of the mast so that it is held in engagement when the cable is under tension and the cable is connected to the base by means of a second connector member, fixed to the lower end of the cable, which can be trapped in the base behind a suitably-shaped retaining aperture, in which each cable is provided with a relatively small fixed connector member at one end, which can be threaded through the retaining aperture in the base from below and inserted into a retaining aperture in the upper end of the mast, and a larger fixed connector member at the other end which is then trapped behind the retaining aperture in the base.

2. A self-supporting display stand according to claim 1 in which the connector members are ball-shaped.

3. A base for a display stand according to claim 2, the base comprising a first pair of generally closed spaced sockets for receiving the lower ends of corresponding support masts, and a second pair of spaced apertures adapted to retain connector members fixed to the ends of the tension cables.

4. A base for a display stand according to claim 1, the base comprising a first pair of generally closed spaced sockets for receiving the lower ends of corresponding support masts, and a second pair of spaced apertures adapted to retain connector members fixed to the ends of the tension cables.

5. An elongate support member adapted to be mounted in a horizontal position on a display stand according to claim 1, comprising a transverse slot or passageway at each end for attachment to a tension cable, and a corresponding blind axial bore at each end for a clamping screw to engage with the cable.

6. A self-supporting display stand according to claim 1 further including an elongated support member for mounting in a generally horizontal position, said elongated support member including at each end a respective clamping means for engaging with a respective one of the tension cables to clamp said elongated support in said generally horizontal position.

7. A self supporting display stand according to claim 6 in which said clamping means each include a transverse slot or passageway at each end for attachment to a respective one of the tension cables, and a corresponding blind axial bore at each end for a clamping screw to engage with the respective cable.

* * * * *